US007854664B1

(12) United States Patent
Comrie

(10) Patent No.: US 7,854,664 B1
(45) Date of Patent: Dec. 21, 2010

(54) GOLF CLUB SUPPORTING ACCESSORY

(76) Inventor: Ronald Comrie, 12309 Wood Sage Ter., Lakewood Ranch, FL (US) 34202

( * ) Notice: Subject to any disclaimer, the term of this patent is extended or adjusted under 35 U.S.C. 154(b) by 31 days.

(21) Appl. No.: 12/425,150

(22) Filed: Apr. 16, 2009

(51) Int. Cl.
*A63B 55/10* (2006.01)

(52) U.S. Cl. ..... 473/282; 294/19.2

(58) Field of Classification Search ..... 473/282, 473/286; 294/19.2; D21/796; 248/156
See application file for complete search history.

(56) References Cited

U.S. PATENT DOCUMENTS

| | | | | |
|---|---|---|---|---|
| 5,080,239 | A * | 1/1992 | Rowland | 211/70.2 |
| 5,143,371 | A * | 9/1992 | Strahan | 473/285 |
| 5,285,990 | A * | 2/1994 | Engel | 248/156 |
| 5,286,019 | A | 2/1994 | Watabe | |
| D363,849 | S | 11/1995 | Bruns et al. | |
| 5,467,980 | A | 11/1995 | Weisenstein | |
| 5,597,363 | A | 1/1997 | Leote | |
| 5,873,471 | A | 2/1999 | Ruggeri | |
| D444,199 | S * | 6/2001 | Shea | D21/796 |
| 6,346,051 | B1 * | 2/2002 | Otsubo | 473/282 |
| 6,383,088 | B1 | 5/2002 | Kershner | |
| 6,419,592 | B1 | 7/2002 | Player | |
| 6,447,407 | B1 * | 9/2002 | Caldwell | 473/408 |
| D472,598 | S * | 4/2003 | Lawrence | D21/796 |
| D505,174 | S * | 5/2005 | Thomas, Sr. | D21/796 |
| 6,962,536 | B2 * | 11/2005 | Hall et al. | 473/282 |
| D600,300 | S * | 9/2009 | Wilson, II | D21/796 |
| 2002/0077190 | A1 * | 6/2002 | Player | 473/282 |
| 2003/0207721 | A1 | 11/2003 | Hall et al. | |
| 2007/0078025 | A1 | 4/2007 | Pepe | |
| 2007/0259731 | A1 * | 11/2007 | Barouh | 473/282 |
| 2008/0146367 | A1 * | 6/2008 | Cruz | 473/286 |
| 2009/0178942 | A1 * | 7/2009 | Balazs | 206/315.1 |

* cited by examiner

*Primary Examiner*—Stephen L. Blau
(74) *Attorney, Agent, or Firm*—Kyle Fletcher

(57) ABSTRACT

The golf club supporting accessory that supports a golf club when not in use and includes a cigar holder, towel holder, and Velcro strip for hanging a glove. The golf club supporting accessory has a stake as the main frame, which is struck into the ground. The supporting member is a hook that enables the grip of a golf club to rest upon.

13 Claims, 3 Drawing Sheets

FIG. 3
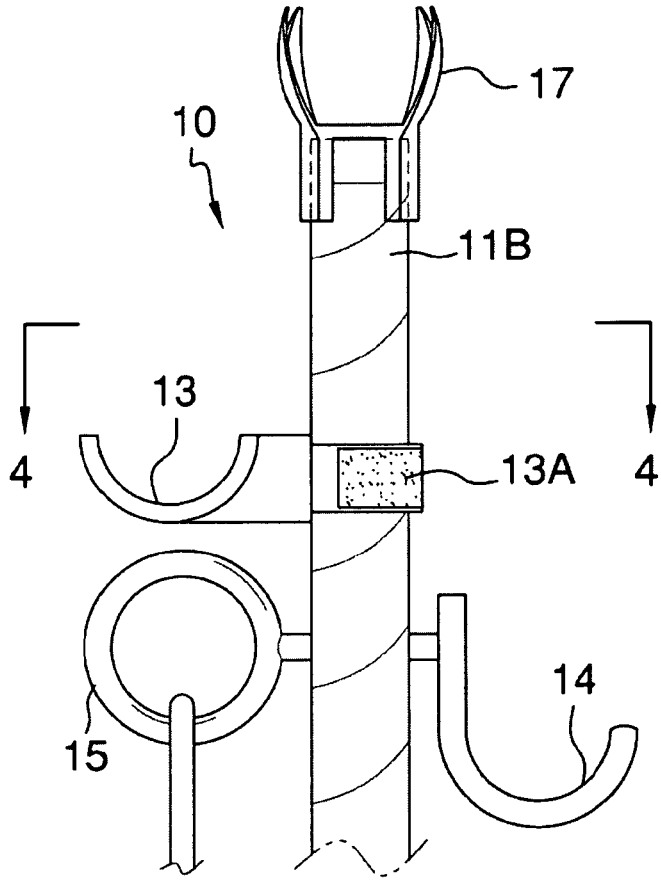
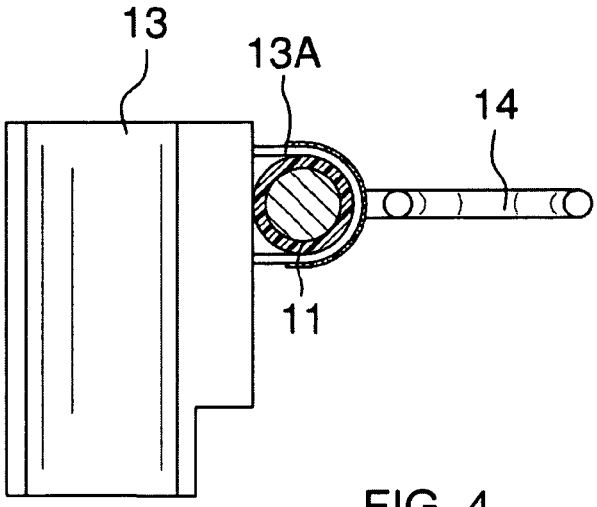
FIG. 4

GOLF CLUB SUPPORTING ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of golf club supports, more specifically, a golf club support having a cigar holder, tee holder, ball holder, towel ring, nylon hook strip for securing a glove, and hook for support of a golf club.

B. Discussion of the Prior Art

As a preliminary note, it should be stated that there is an ample amount of prior art that deals with golf club supports. As will be discussed immediately below, no prior art discloses a golf club support that has a cigar holder, towel ring, and Velcro strip for hanging items, such as a glove.

The Otsubo patent (U.S. Pat. No. 6,346,051) discloses a golf club supporting device that can hold multiple golfing accessories and a cigar. However, the supporting device includes a bend and arm along the bottom for stopping the stake from cigar as opposed to a horizontally oriented cigar holder.

The Player patent (U.S. Pat. No. 6,419,592) discloses a ground inserted golf club retention device that has a towel holder. However, the retention device does not have a cigar holder, and Velcro strip for hanging a glove.

The Pepe Patent Application'Publication (U.S. Pub. No. 2007/0078025) discloses a golf club rest that includes a ground inserted member. However, the golf club rest fails to include a cigar holder, towel ring, and Velcro strip for hanging a glove.

The Hall et al. Patent Application Publication (U.S. Pub. No. 2003/0207721) discloses a golf accessory having multiple functions. However, the golf accessory fails to include a ring for hanging a towel and a Velcro strip for hanging a glove when not in use.

The Ruggeri patent (U.S. Pat. No. 5,873,471) discloses a golf club support that includes a vertical post with a flare and sharpened end driven into the ground. However, the golf club support does not include a cigar holder, towel ring, and Velcro strip for hanging a glove.

The Leote patent (U.S. Pat. No. 5,597,363) discloses a ground engaging golfer's accessory that includes a means for holding a towel, golf club, and golf ball. However, the accessory does not include a cigar holder, and Velcro strip for hanging a glove.

The Weistenstein patent (U.S. Pat. No. 5,467,980) discloses a device for supporting at least a portion of a golf club relative to a ground surface, and of which includes ground engaging member and a handle engaging assembly. However, the device fails to include a cigar holder, towel ring, or Velcro strip for hanging a glove.

The Kershner patent (U.S. Pat. No. 6,383,088) discloses a ground inserted golf club retention device that can support multiple clubs. However, the device fails to include a cigar holder, towel ring, or Velcro strip for hanging a glove.

While the above-described devices fulfill their respective and particular objects and requirements, they do not describe a golf club supporting accessory that includes a cigar holder, tee holder, ball holder, towel ring, nylon hook strip for securing a glove, and hook for support of a golf club. In this regard, the golf club supporting accessory departs from the conventional concepts and designs of the prior art.

SUMMARY OF THE INVENTION

The golf club supporting accessory that supports a golf club when not in use and includes a cigar holder, tee holder, ball holder, towel ring, nylon hook strip for securing a glove, and hook for support of a golf club. The golf club supporting accessory has a stake as the main frame, which is struck into the ground. The supporting member is a hook that enables the grip of a golf club to rest upon.

An object of the invention is to provide a golf club supporting accessory that keeps a golf club off of the ground.

A further object of the invention is to provide a place to hold a golf towel, golf glove, plurality of tees, golf ball, and cigar or cigarette.

A further object of the invention is to provide a golf club supporting accessory that is effective, easy to use, affordable, and simplistic in design.

These together with additional objects, features and advantages of the golf club supporting accessory will be readily apparent to those of ordinary skill in the art upon reading the following detailed description of presently preferred, but nonetheless illustrative, embodiments of the golf club supporting accessory when taken in conjunction with the accompanying drawings.

In this respect, before explaining the current embodiments of the golf club supporting accessory in detail, it is to be understood that the golf club supporting accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the golf club supporting accessory. It is therefore important that the claims be regarded as including such equivalent construction insofar as they do not depart from the spirit and scope of the golf club supporting accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 3 illustrates a side view of the cigar holder, ball holder, ring, and hook;

FIG. 4 illustrates a cross-sectional view of the invention along line 4-4 in FIG. 3.

DETAILED DESCRIPTION OF THE EMBODIMENT

Figure 1:
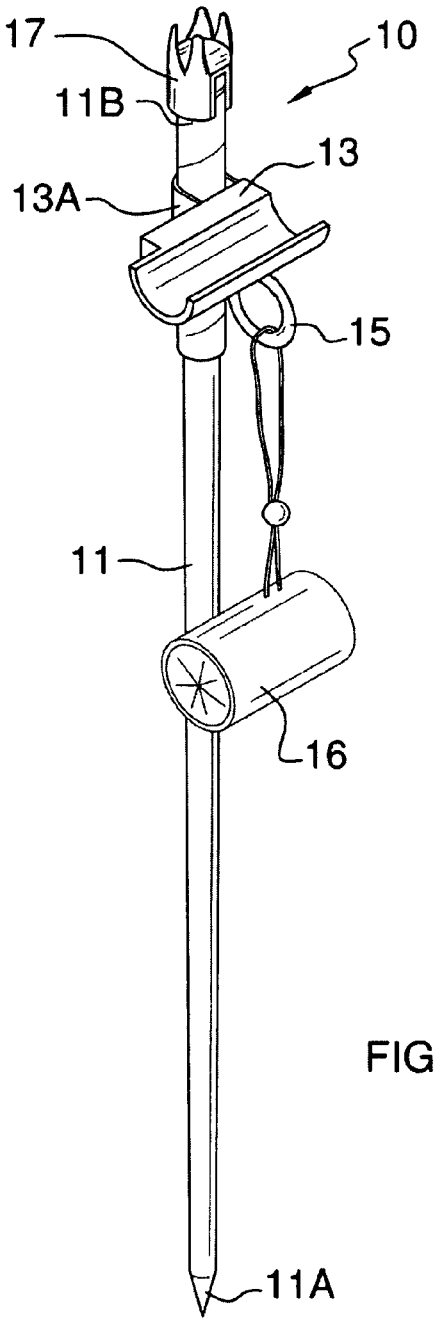
FIG. 1 illustrates a front, isometric view of the invention by itself.
Figure 2:
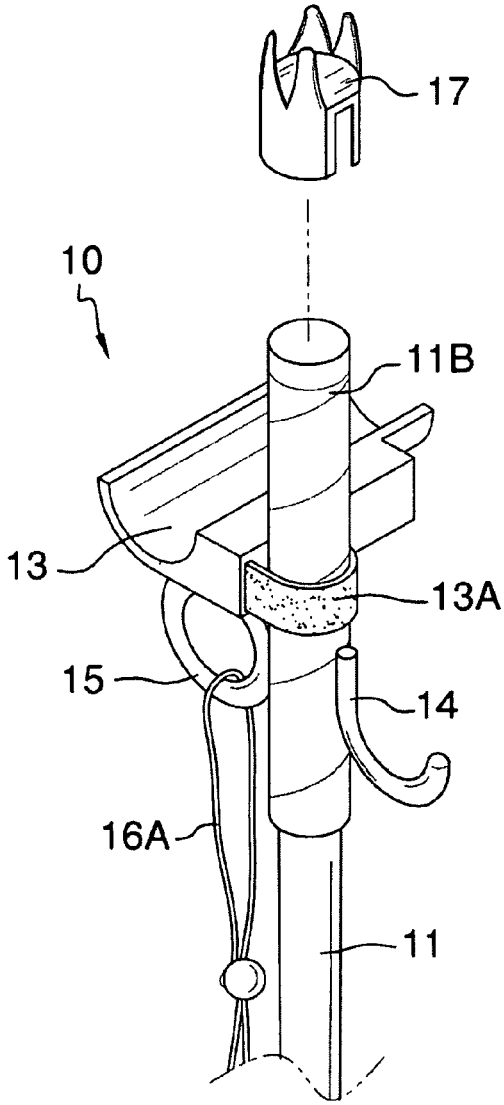
FIG. 2 illustrates a rear, detailed view of the cigar holder, ball holder removed from the grip.

Detailed reference will now be made to the preferred embodiment of the present invention, examples of which are illustrated in FIGS. 1-5. A golf club supporting accessory 10 (hereinafter invention) includes a stake 11, a grip 11B, a cigar holder 13, a hook 14, a ring 15, a tee holder 16, and a ball holder 17.

Figure 5:
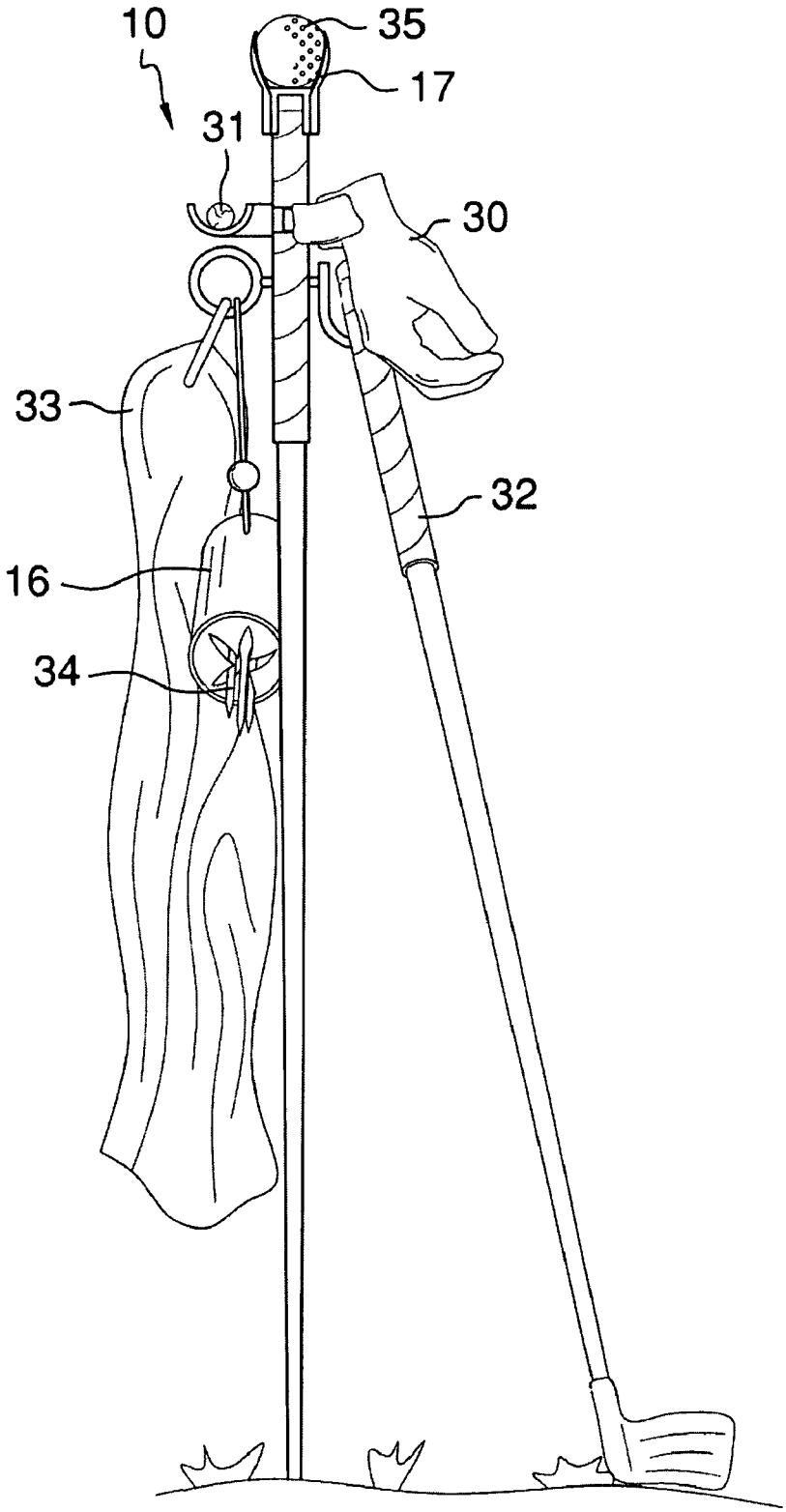
FIG. 5 illustrates a side view of the invention in use with a golf club, tee holder with a plurality of tees, cigar, towel, and glove.

The stake 11 has a pointed end 11A for insertion into the ground, see FIG. 5. The stake 11 has an overall length ranging from 2 to 5 feet, and is made of a material comprising a wood, metal, or durable plastic. A top end of the stake 11 is where a grip 11B is located.

The cigar holder 13 secures itself about the grip 11B via a strap 13A. The strip 13A can attach or detach from the grip 11B. The exterior of the strip 13A is adorned with a securing means designed to support a golf glove 30 via the nylon hook and loop strips of the golf glove 30. The securing means comprises a strip of either nylon hook or loop material.

The tee holder 16 dangles from the ring 15 via a strap 16A, and is capable of storing a plurality of golf tees 34. Meanwhile the ball holder 17 fits onto the top of the grip 11B of the stake 11, and supports a golf ball 35. The tee holder 16 and golf ball holder 17 are made of a material comprising a plastic, metal, or wood.

The cigar holder 13 is generally horizontal such that a cigar 31 can rest thereupon. The hook 14 attaches to the outer surface of the grip 11B and enables a golf club 32 to rest there upon. The ring 15 is used to support a towel 33 about the invention 10. The cigar holder 13, the hook 14, and the ring 15 are made of a material comprising a metal, wood, or durable plastic.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A golf club supporting accessory comprising:

(a) a stake;

wherein the stake has a pointed in for insertion into ground;

wherein the stake has a grip about a top end;

wherein the grip has a hook upon which a golf club grip is able to interact in order to support the golf club;

wherein the grip has a ring for supporting a towel;

(b) a horizontally-oriented cigar or cigarette holder;

wherein the holder secures itself about the grip of the stake via a strap;

wherein the strap has a golf glove supporting means.

2. The golf club supporting accessory as described in claim 1 wherein the stake has a length ranging two to four feet.

3. The golf club supporting accessory as described in claim 1 wherein the stake is made of a material comprising a wood, metal, or durable plastic.

4. The golf club supporting accessory as described in claim 1 wherein the supporting means is a strip of nylon hook material.

5. The golf club supporting accessory as described in claim 1 wherein the supporting means is a strip of nylon loop material.

6. The golf club supporting accessory as described in claim 1 wherein the strap of the holder can attach and detach from the grip of the stake.

7. The golf club supporting accessory as described in claim 1 wherein the holder, hook, and ring are made of a material comprising a wood, metal, or durable plastic.

8. The golf club supporting accessory as described in claim 1 wherein a tee holder that can hold a plurality of golf tees attaches to the ring and hangs from below said ring.

9. The golf club supporting accessory as described in claim 8 wherein the tee holder is made of a material comprising a plastic, wood, or metal.

10. The golf club supporting accessory as described in claim 1 wherein a golf ball holder attaches to the top grip of the stake and supports a golf ball.

11. The golf club supporting accessory as described in claim 10 wherein the golf ball holder is made of a material comprising a metal, wood, or plastic.

12. The golf club supporting accessory as described in claim 1 wherein a tee holder that can hold a plurality of golf tees attaches to the ring and hangs from below said ring; and a golf ball holder attaches to the top grip of the stake and supports a golf ball.

13. The golf club supporting accessory as described in claim 12 wherein the tee holder and golf ball holder are made of a material comprising a plastic, wood, or metal.

* * * * *